United States Patent [19]

Bengtsson et al.

[11] 4,222,507

[45] Sep. 16, 1980

[54] FOLDING MACHINE FOR SHIRTS AND SIMILAR GARMENTS

[76] Inventors: Alf R. A. Bengtsson, Åkerbo 2, S-51020 Fritsla; John L. Carlborg, Åsen, S-52300 Ulricehamn; Bengt R. E. Ewertsson, Poppelvägen 8, S-51300 Fristad, all of Sweden

[21] Appl. No.: 950,156

[22] Filed: Oct. 10, 1978

[30] Foreign Application Priority Data

Oct. 10, 1977 [DE] Fed. Rep. of Germany ..... 2745517

[51] Int. Cl.[2] ..... A41H 33/00

[52] U.S. Cl. ..... 223/37

[58] Field of Search ..... 223/2, 3, 27, 28, 35, 223/37, 52, 52.1, 52.3, 70; 38/12, 13

[56] References Cited

U.S. PATENT DOCUMENTS

| | | | |
|---|---|---|---|
| 3,013,704 | 12/1961 | Freeman | 223/37 |
| 4,026,444 | 5/1977 | Harjapää | 223/37 |

*Primary Examiner*—Louis Rimrodt
*Attorney, Agent, or Firm*—James E. Nilles

[57] ABSTRACT

An automatic garment folding machine has a support plate on which the upper central portion of a garment rests, a cover plate which swings down to an operative position overlying that portion of the garment, and side folding plates by which longitudinally extending side portions of the garment are folded into overlapping relationship over its central portion. The cover plate has fixed and movable clamping members, the movable clamping member being movable downward to and upward from a clamping position in which it cooperates with the fixed clamping members, which are on the upper surface of the cover plate, to effect undulatory foreshortening of the folded and overlapped garment side portions, thus laterally tensioning the upper central portion of the garment into smooth flatness as well as confining the folded and overlapped portions against disarrangement by the side folding plates as they move back to starting positions.

5 Claims, 7 Drawing Figures

FOLDING MACHINE FOR SHIRTS AND SIMILAR GARMENTS

FIELD OF THE INVENTION

This invention relates to a machine by which shirts and similar garments are folded to be packaged for display and sale, and the invention is more particularly concerned with improvements in an automatic machine of that type whereby the upper central front portion of a garment folded on the machine—which portion is normally visible after the garment is packaged—is slightly tensioned during the folding operation to ensure that it will be smooth and flat and when folding of the garment has been completed and after fasteners have been inserted into the garment to hold it in folded condition.

BACKGROUND OF THE PRIOR ART

West German published patent application No. 2,608,462, which is a substantial counterpart of U.S. Pat. No. 4,026,444, discloses a garment folding machine of the general type to which the present invention relates. In using the machine of that patent to fold a shirt, the operator places the buttoned, flattened and spread-out garment, front side down, onto a support plate that supports the central longitudinally extending portion of the garment and over side folding plates extending to opposite sides of the support plate and arranged to support longitudinally extending side portions of the shirt. The central portions of the shirt tails overlie a rear folding plate. When the shirt is thus arranged, a front cover plate that is hinged to the front of the machine is swung down over the collar and upper central portion of the shirt, to flatwise overlie these and the support plate. Thereafter a rear cover plate, hinged to the rear of the rear folding plate, is swung downwardly and forwardly to flatwise overlie the central tail portions of the shirt and the rear folding plate. Downward movement of the rear cover plate to its operative position causes the machine to be started in its automatic folding cycle. First one and then the other of the side folding plates move edgewise inwardly over the cover plates to fold the longitudinally extending side portions of the shirt over its central portion and into overlapping relation to one another. When the side folding plates have returned to their starting positions, the rear folding plate moves forwardly more or less edgewise, to fold the tail portion of the shirt upwardly over its central portion and over the overlapped side portions. A stapling device then fastens together the several superimposed layers of the shirt to maintain it in folded condition. Thereafter the front cover plate automatically swings up to its raised position and the shirt can be slid off of it, upwardly and rearwardly, ready for packaging.

It is desirable that a shirt or similar garment which has been folded and packaged for sale should display a completely smooth front surface and that no parts should hang out at the sides of the folded garment. However, with the above described machine there was a possibility that, owing to friction or static electricity, the longitudinally extending side portions of the garment might cling to the side folding plates as those plates returned to their starting positions, and thus the garment could be partly unfolded and would display unevenly folded side edges, or its visible front surface could have wrinkles or could be objectionably loose rather than being under a smoothing and flattening tension. To avoid these problems it was often the practice of the operator of such a machine to manually restrain portions if the garment against unfolding and to manually displace portions of it as necessary to achieve a desired tensioning of its front surface. However, the operator's hands could not remain on the garment during the forward motion of the rear folding plate, and any tension that had been imposed upon the garment was likely to be lost as soon as the operator's hands were removed. Furthermore, the need for the operator to provide manual assistance to the machine imposed a strain upon the operator, required a slowing-down of the machine cycle, and required the operator to be cooperating with the machine at a time when the operator could have been more profitably employed in some other occupation.

U.S. Pat. No. 2,367,261 discloses a shirt folding table that merely served as an auxiliary which aided in the folding of shirts and required all operations to be performed manually. It comprised a cover plate that was swung down over a shirt positioned on the folding table and on which there was mounted a clamping device in the form of a claw. The claw, which was disposed on the longitudinal axis of the cover plate, could be manually moved between an inoperative position and a clamping position and tended to be retained in each of those positions under spring bias. It was so arranged on the cover plate that it remained uncovered as the longitudinally extending side portions of the shirt were folded. In its clamping position it rested on the folded-in side portions near their shoulder edges, in an area where those side portions overlapped one another. Since this claw was intended merely as an aid to a person doing manual folding, its use was discretionary with that person. When employed, it engaged the folded-in portions of the shirt only in a limited area at the shoulders, and therefore it could not tension the shirt in the transverse direction so as to produce a stretching and flattening of the displayed front part of the shirt.

The present invention has for its object the improvement of an automatic garment folding machine of the general type disclosed in the above mentioned West German published patent application, whereby such a machine, once started in its automatic operation, no longer needs attention or cooperation from an operator but can consistently achieve very neat and satisfactory folding and fastening of a shirt or similar garment, assuredly causing the folded garment to have straight and regular side fold lines and to display a smooth, flat front surface.

It is also an object of this invention to provide an automatically operable clamping device for a garment folding machine of the character described, whereby folded-over longitudinally extending side portions of a garment are securely held against displacement during and after the time that the side folding plates are being returned to their starting positions, so that those portions of the garment are restrained against disarrangement or partial unfolding by the outwardly moving side folding plates, and whereby the front central portion of the garment is so tensioned as to ensure that it will be flat and smooth at the time the garment is stapled or otherwise secured in its folded condition.

A further object of the invention is to provide a simple and inexpensive clamping device of the character just described that can be readily arranged for automatic operation in proper synchronism with other elements of an automatic garment folding machine and which makes possible a uniform tensioning of the displayed front part of every folded garment so that all garments folded by means of the machine can have a neat and uniform appearance.

Another and more specific object of the invention is to provide a clamping mechanism for a garment folding machine of the above described character, which clamping mechanism disengages itself from a folded garment as soon as the garment is ready to be removed from the machine but releases itself in such a manner as not to have any tendency to disarrange the folded garment nor interfere with its removal from the machine.

SUMMARY OF THE INVENTION

The invention resides in fixed and movable clamping means in a machine of the character described, the fixed clamping means being on the front cover plate and defining surface areas which are at an elevation above the top surface of that cover plate and which extend parallel to its side edges, the movable clamping means being movable downwardly to and upwardly from an operative position of clamping cooperation with that upper surface, said clamping means being arranged to effect an undulatory transverse foreshortening of overlapped garment side portions confined between them whereby the upper central portion of the garment is transversely tensioned.

BRIEF DESCRIPTION OF THE DRAWINGS

A preferred embodiment of the invention is illustrated in the accompanying drawings, in which.

Figure 1:
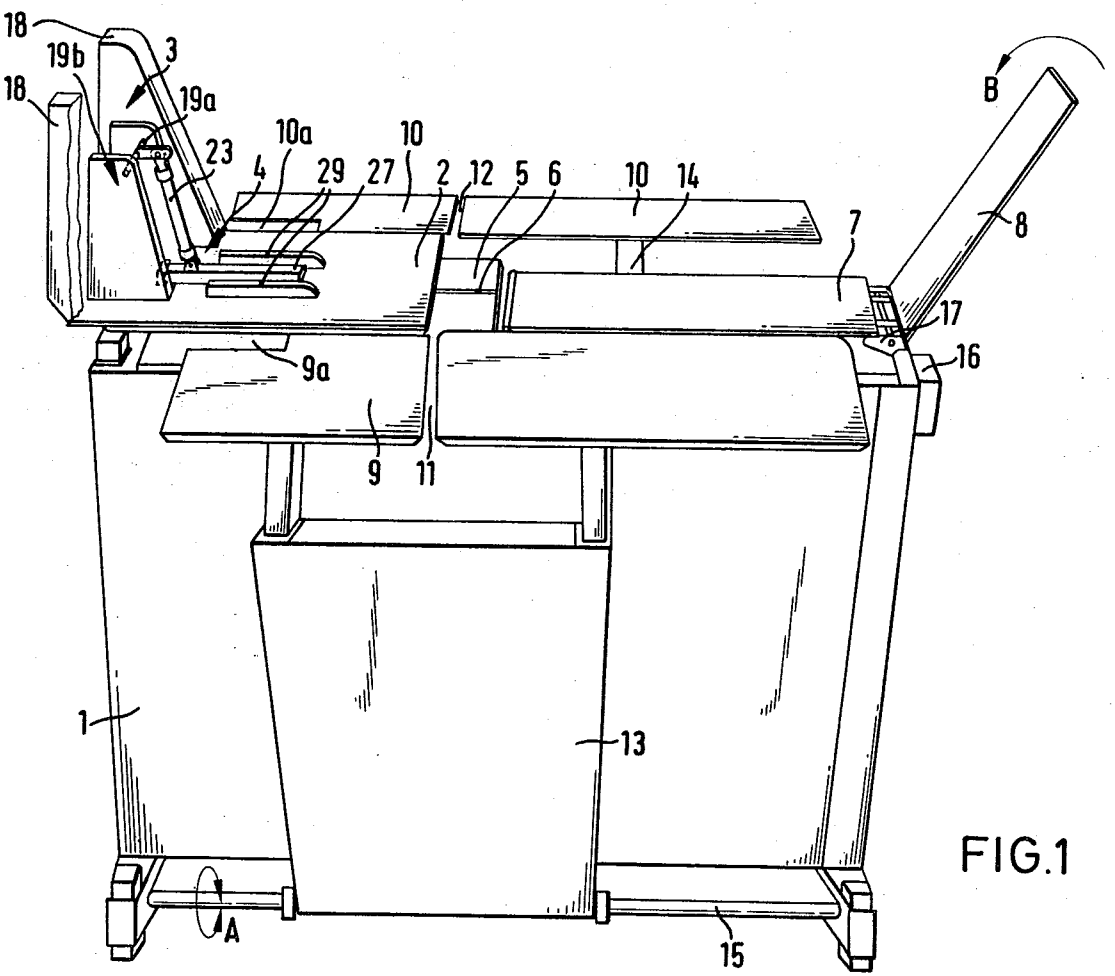
FIG. 1 is a perspective view of a machine for folding shirts and similar garments that embodies the principles of this invention.

Referring now to the accompanying drawings, the garment folding machine of this invention, which is shown in its entirety in FIG. 1, has a housing 1 of substantially rectangular shape that comprises a frame for the machine and provides support for its working parts. At an upper portion of the machine there is a fixed horizontal support plate 5 that is substantially rectangular and is elongated in a front-to-rear direction (left-to right as seen in FIG. 1). Only a rear portion of the support plate 5 is visible in FIG. 1, its front portion (to the left in FIG. 1) being hidden by other parts of the machine. For purposes of illustration, a garment 30 to be folded by means of the machine can be assumed to be a shirt having a buttoned front opening and a collar at its top. The support plate 5 supports the central portion **30*b* of the shirt along a substantial part of its length, the shirt being placed on that plate front downward with its buttons received in a button groove 6 in the support plate that extends along its lengthwise centerline. It will be understood that, as is conventional, the collar of the shirt is received in a collar recess in the front portion of the support plate and is fitted around a collar tensioning device in that recess, but neither the recess nor the tensioning device is visible in FIG. 1**.

A flattened, unfolded shirt positioned on the support plate 5 has its lower or tail portion overlying a rear folding plate 7 while its longitudinally extending side portions overlie side folding plates 9 and 10. The folding plates 7, 9 and 10 are shown in FIG. 1 in starting positions in which they are nearly coplanar with the support plate 5 and in which the rear folding plate 7 extends rearwardly from the rear edge of the support plate while the side folding plates 9 and 10 extend in opposite lateral directions from its side edges. As explained hereinafter, each of the folding plates 7, 9 and 10 is movable or less edgewise out of its starting position to a position in which it flatwise overlies the support plate 5, so that in each case the portion of the garment that overlies the folding plate is folded to overlie the upper central garment portion that rests on the support plate.

Figure 2:
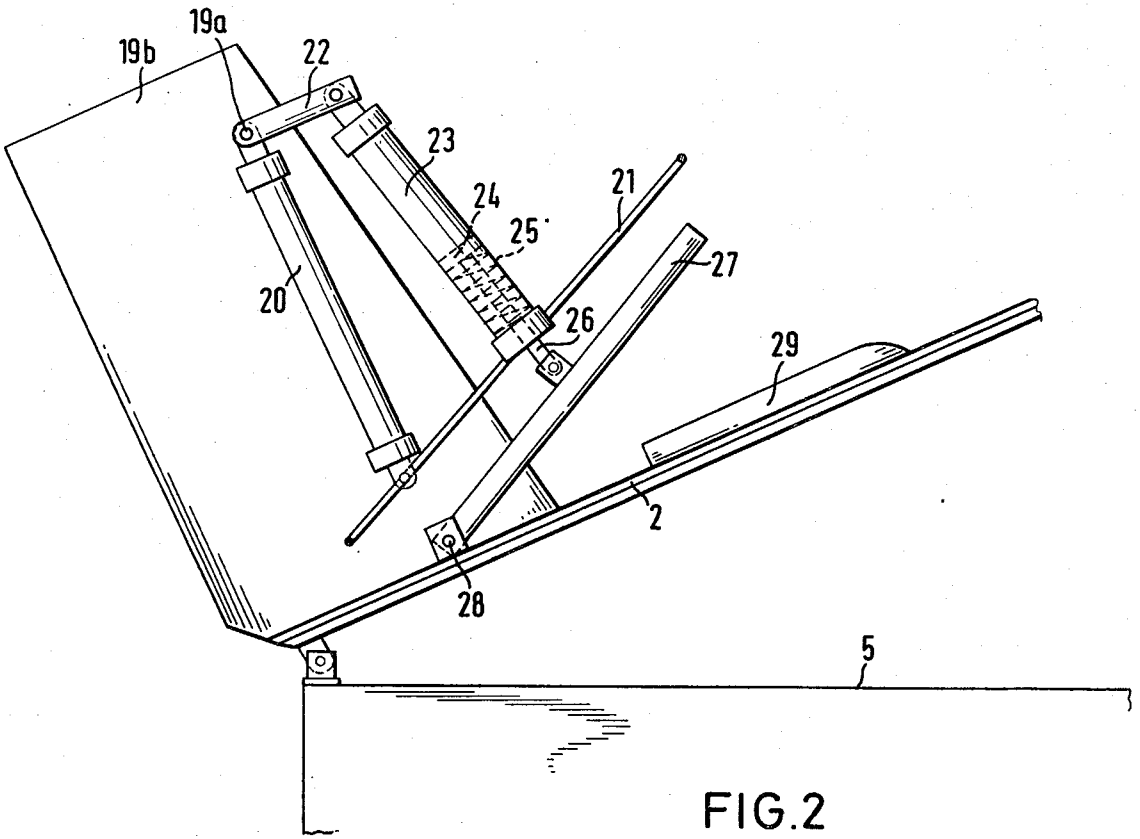
FIG. 2 is a fragmentary view in side elevation, on an enlarged scale, illustrating the portions of the machine that effect tensioning of a garment.

Before this folding operation can take place, however, a front cover plate 2 must be swung down from an inoperative position in which it is shown in FIG. 2 to an operative position in which it is shown in FIG. 1, and in which it flatwise overlies the support plate 5; and a rear cover plate 8 must likewise be swung down from an inoperative position in which it is shown in FIG. 1 to an operative position in which it flatwise overlies the rear folding plate 7.

For its swinging motion, the front cover plate 2, as shown in FIG. 2, has a hinged or pivotal connection to the top of the housing or frame 1 of the machine, the axis of that connection being horizontal and extending along the front edge of the machine as well as along the front edge of the cover plate so that the cover plate swings flatwise rearwardly and downwardly to its operative position. The rear cover plate 8, as shown in FIG. 1, has at its rear edge a hinged connection to the rear edge of the rear folding plate 7 whereby the cover plate 8 can be swung flatwise downwardly and forwardly towards its operative position, as denoted by the arrow B in FIG. 1, and whereby it is constrained to partake of motion of the rear folding plate 7.

Figure 5:
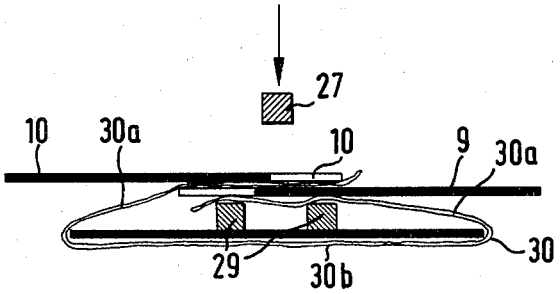
FIG. 5 is a view in section, taken on the plane of the line V—V in FIG. 3 but illustrating a stage in the operation which directly follows that shown in FIG. 3.

Each of the side folding plates 9 and 10 can be formed in two parts for flexiblity. The components parts of the plates 9, 10 are separated by a small gap 11, 12, respectively. As can be seen in FIG. 1, the side folding plate 9 is carried on supporting structure 13 that is in turn mounted for swinging motion on a pivot rod 15 which extends from front to rear of the machine near the bottom. As the pivot rod 15 is rotated first in one direction and then in the other, as denoted by the arrow A in FIG. 1, it imparts a swinging motion to the supporting structure 13 whereby the side folding plate 9 is carried more or less edgewise laterally inwardly and then laterally outwardly, in an arc of substantially large radius. Such motion of the side folding plate 9 occurs when the front cover plate 2 is in its operative position illustrated in FIG. 1. At the laterally inward limit of its motion (illustrated in FIG. 5) the side folding plate 9 flatwise overlies a substantial portion of the width of the front cover plate 2 and is spaced a distance above it.

The opposite side folding plate 10 is mounted on the opposite side of the machine, on supporting structure 14 comprising an arrangement generally similar to that for the side folding plate 9, and the side folding plate 10, like its opposite counterpart 9, swings edgewise laterally inwardly and laterally outwardly in an arc of substantially large radius. At the laterally inward limit of its motion, shown in FIG. 5, the side folding plate 10 lies in flatwise overlapping relation to the front cover plate 2 and the side folding plate 9 and is disposed at a slightly higher level above the cover plate 2 than the side folding plate 9. When in their starting positions illustrated in FIG. 1, the side folding plates 9 and 10 have their laterally inner edges spaced a small distance outward from the side edges of the support plate 5.

Figure 3:
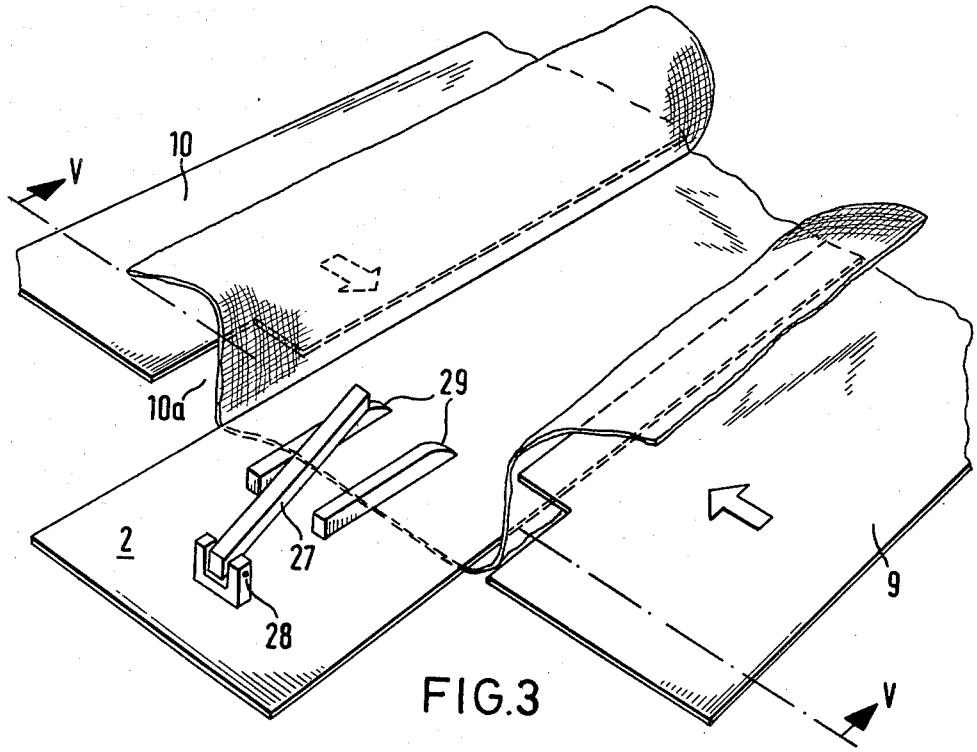
FIG. 3 is a fragmentary perspective view showing portions of the machine in an initial stage of operation.
Figure 4:
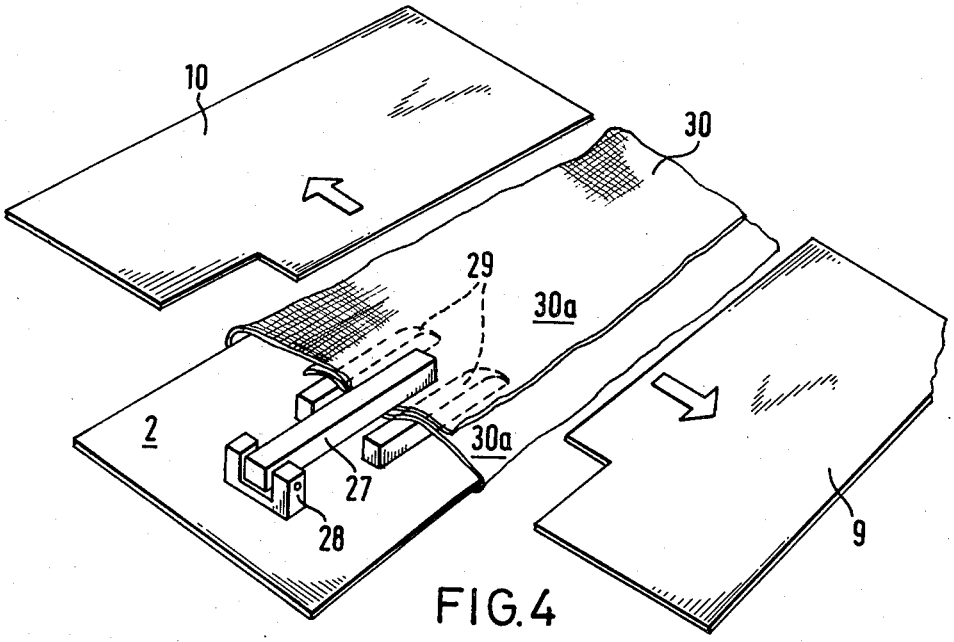
FIG. 4 is a view similar to FIG. 3 but illustrating a later stage in the operation.
Figure 6:
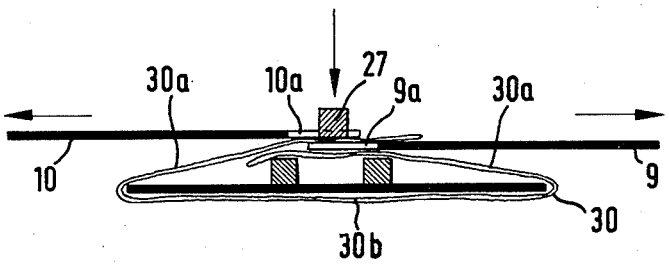
FIG. 6 is a view generally similar to FIG. 5 but showing a stage in the operation which immediately follows that depicted in FIG. 5.

When a shirt or similar garment 30 is disposed as described above, with its longitudinally central portions **30*b* overlying the support plate 5 and the rear folding plate 7 and with its longitudinally extending side portions 30*a* overlying the side folding plates 9 and 10, lowering of the front cover plate 2 and the rear cover plate 8 to their operative positions brings them into flatwise overlying relation to the longitudinally central portions of the garment and confines those portions of the garment against displacement normal to the planes of those plates. Thereafter, as the side folding plate 9 makes a laterally inward traverse (see FIG. 3) to its limit position shown in FIG. 5, the longitudinally extending side portion 30*a* of the garment which had been overlying that folding plate is folded to a position in which it overlies the cover plates 2 and 8 and hence overlies the longitudinally central portion 30*b* of the garment. As the side folding plate 9 is in the final portion of such a folding traverse, the side folding plate 10 begins a similar folding transverse, but of course moves laterally inwardly from the opposite direction, and the other longitudinally extending side portion 30*a* of the garment, which had been overlying the folding plate 10, is thus brought to the condition shown in FIG. 5 in which it overlies a part of the side folding plate 9 and thus overlies the central longitudinal portion 30*b* of the garment as well as overlapping the other longitudinal side portions 30*a* of the garment. With the garment thus partially folded, the side folding plates can begin their return movements to their rest positions, as shown in FIG. 6, Before going on to a description of the remainder of the operation, attention must now be given to certain other structural features of the machine. After a garment has been initially positioned on the machine, as described above, the operator must first swing the front cover plate 2 down to its operative position and should thereafter swing the rear cover plate 8 downward and forward. This sequence must be followed because movement of the rear cover plate 8 to its operative position initiates the automatic operation of the machine, whereafter nothing more need be done by the operator until the completely folded garment, stapled into its folded condition, is ready to be removed from the machine. For initiating such automatic operation, a switch 16 is mounted on the rear of the machine frame and a projecting dog 17 on the rear cover plate 8** is arranged to actuate said switch to its "on" position in consequence of that cover plate being swung down to its operative position.

The drive and timing mechanisms controlled by the switch 16, which can be enclosed within the housing 1, are not illustrated inasmuch as they are conventional. Upon closure of the switch 16, the side folding plates 9 and 10 are caused to move through their sequence of folding operations, and just as they begin their return movements a clamping of the overlapping, folded-over portions **30*a* of the garment is caused to take place, effected by clamping means generally designated by 4**, which is novel with the machine of this invention and which will now be described.

Referring now particularly to FIGS. 1 and 2, a relatively fixed component of the clamping means 4 comprises two elongated counterforce members or tensioning elements 29 that are mounted on the upper surface of the front cover plate 2. They extend lengthwise along that cover plate through a zone spaced from both its front and its rear edges. The two counterforce members 29 extend substantially parallel to one another and are spaced at equal distances to opposite sides of the longitudinally extending center line of the front cover plate 2. Each of the counterforce members 29 has a substantially rectangular cross section all along its length, and its rear end portion is rounded off, as shown, or is otherwise suitably tapered in height towards the rear.

The movable clamping means that cooperates with these counterforce members 29 is illustrated as an elongated clamping member 27 which is mounted on the front cover plate for movement downwardly to and upwardly away from a clamping position (shown in FIG. 1) in which said clamping member closely overlies the cover plate 2 and is disposed between the two counterforce members 29. Like the fixed counterforce members 29, the movable clamping member 27 can have a substantially rectangular cross-section along its length. Its width is such that when it is in its operative clamping position there is some space between its opposite sides and each of the counterforce members 29.

As shown, the clamping member 27 has swinging motion to and from its clamping position by reason of a pivot connection 28 (see FIG. 2) between its front end and the front cover plate 2, which connection defines a horizontal, transversely extending axis for the clamping member. Thus, in the particular embodiment shown, the clamping member 27 constitutes a lever that is fulcrumed at its front end, and it is swung up and down relative to the front cover plate 2 by means of an actuator 23 which has a pivoted connection with it intermediate its ends and which comprises a pneumatic cylinder mechanism. At its upper end the cylinder of the actuator mechanism 23 has a swivel connection to an arm 22 that is fixed in relation to the cover plate 2 as described hereinafter. The piston rod 26 of the actuator, which has the pivoted connection with the clamping member, is surrounded by a coiled compression spring 25 that reacts between the lower end of the cylinder and the piston 24 therein to bias the clamping member upwardly and away from its clamping position.

Figure 7:
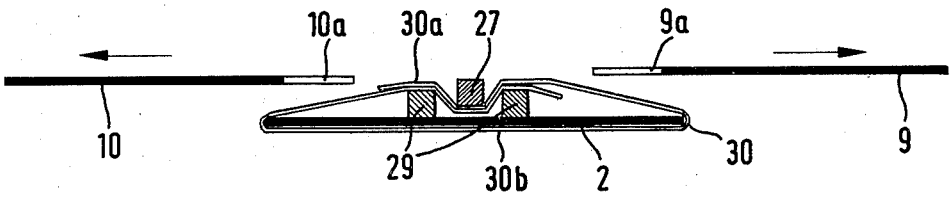
FIG. 7 is a view generally like FIGS. 5 and 6 but showing a stage in the operation which follows that illustrated in FIG. 6 and immediately precedes that of FIG. 4.

Pneumatic pressure in the cylinder, acting on the piston 24, can overcome the bias of the spring 25 and swing the clamping member 27 down to its operative position. Such clamping movement of the clamping member 27 is caused to occur at a time in the operating cycle of the machine when the side folding plates 9 and 10 are just beginning their return movements; and at that time, as shown in FIG. 6, notches **9*a* and 10*a* in the laterally inner edges of those folding plates, near their front ends, permit the clamping member 27 to pass downwardly between those plates and into engagement with the folded and overlapping longitudinally extending side portions 30*a* of the garment that overlie the front cover plate 2 and the counterforce members 29 thereon. As best seen in FIG. 7**, the clamping member 27, by its continued downward movement after it engages the overlapped garment portions 30*a*, cooperates with the counterforce members 29 to effect a transverse foreshortening of those garment portions, whereby, in turn, the front portion 30*b* of the garment, which underlies the front cover plate 2, is laterally tensioned to bring it to the desired smooth and neat appearance. As will be apparent from FIG. 7, the transverse foreshortening of the folded and overlapped garment portions 30*a* is the result of the clamping arm 27 and the counterforce members 29 arranged in such relationship to one another across the width of the overlapped garment portions that with the clamping arm 27 in its operative position those members impart to the overlapped garment portions an undulatory configuration, with those areas of the garment that overlie the fixed clamping members 29 being at a level above the upper surface of the front cover plate 2 while those areas that are engaged by the movable clamping member 27 are at or near said cover plate surface.

As the side folding plates 9 and 10 continue their laterally outward movements back to their starting positions, following engagement of the overlapping garment portions 30*a* by the movable clamping member 27, that clamping member confines those garment portions against any displacement or disarrangement by the outwardly moving folding plates 9, 10, such as might otherwise be caused by clinging due to friction or static electricity, and also securely maintains the tension across the front portion 30*b* of the garment.

While the movable clamping member 27 remains thus engaged with the garment, and at about the time that the side folding plates 9 and 10 reach their starting positions, the rear folding plate 7, with the rear cover plate flatwise overlying it, is caused to make a substantially edgewise forward movement that carries it up over the front cover plate 2 as well as over the engaged clamping member 27 and the counterforce members 29. It will be seen that the rounded or tapered rear end portions of the counterforce members accommodate such movement of the rear folding plate. This forward excursion of the rear folding plate 7 has the effect of folding the bottom portion of the garment forwardly over its top portion and completes the folding of the garment.

As soon as the folding operation is completed, a stapling operation is caused to take place whereby suitable staples are inserted through the folded layers of the garment that overlie the front cover plate 2, near the shoulder seams, to secure the garment in its folded condition. The mechanism 3 by which such stapling is accomplished is an essentially conventional one, comprising two substantially pyramid-type stapling devices 18 arranged on the front cover plate 2, near the front edge thereof, one of them being shown partly broken away in FIG. 1. The stapling device further comprises a pair of laterally spaced supporting uprights 19*b* that are fixed on the front cover plate 2 between the pyramidal structures and are connected at their tops by a rod 19*a*. Swingably mounted on the rod 19*a* is a cylinder actuator 20 by which a security arm 21 is brought down over the folded garment for the stapling operation. Other details of the stapling devices are not disclosed inasmuch as such devices are well known.

The rod 19*a* also has secured to it the rear end of the arm 22, to the front end of which the actuator 23 for the clamping member 27 is swingably connected. The rod 19*a* is constrained against rotation and the arm 22 is fixed to that rod to project rearwardly from it substantially parallel to the front cover plate 2.

When the rear folding plate 7 has moved back to its starting position and the stapling operation has been performed, the front cover plate 2 automatically swings up to its starting position shown in FIG. 2 and the garment, now ready for packaging, can be removed by sliding it rearwardly off of that cover plate. However, before the garment can be removed from the front cover plate, the clamping force upon the movable clamping member 27 must be relieved, and to that end air is vented rather slowly from the cylinder actuator 23, as by releasing it through a throttling valve (not shown). By thus controlling the reduction of downward force upon the piston 24 of the actuator 23, the spring 25 is prevented from abruptly raising the movable clamping member 27 against the overlapped portions of the garment which overlie the clamping member. Furthermore, the force of the spring 25 is sufficiently light so that the clamping member, in being raised, cannot bear upon those overlapped portions hard enough to distort the folded form of the garment. In the normal course of the work process the folded garment will have been removed from the front cover plate 2 before the clamping member 27 and its actuator 23 have fully returned to their starting positions.

Although the clamping means 4 could be manually controlled at appropriate times in the machine cycle, it will be apparent that very simple and obvious means can be arranged for effecting automatic control of the clamping actuator 23 in synchronism with movements of the folding plates 7, 9 and 10 and the stapling device 3; and with such automatic control there is no need for an operator to be concerned with operation of the machine from the time the rear cover 8 is swung to its operative position until the folded and stapled garment is ready to be removed from the machine.

From the foregoing description taken in connection with the accompanying drawings it will be apparent that this invention provides improvements in an automatic machine for folding shirts and similar garments whereby assurance is obtained that the visibly exposed upper central portion of the folded garment will be smooth and flat and that the folds along the sides of the folded garment will be neatly straight and regular.

We claim:

1. A garment folding machine of the type comprising a support plate which has opposite side edges and which supports an upper central portion of a garment in flat, front-down condition, a cover plate movable to and from an operative position in which said cover plate flatwise overlies said support plate and a portion of a garment supported thereon, and a pair of side folding plates, one for each side edge of the support plate, each having a starting position in which the side folding plate has an inner side edge near its side edge of the support plate and in which the side folding plate supports a longitudinally extending side portion of a garment, said side folding plates being movable substantially edgewise towards one another out of their starting positions to fold said side portions of the garment into overlapping relationship over the cover plate and the upper central portion of the garment, said garment folding machine being characterized by means for preventing said side portions of a garment from being disarranged from their overlappingly folded relationship during return movement of the side folding plates to their starting positions and for establishing and maintaining a transverse tensioning of the upper central portion of the garment whereby the same is caused to be flat and smooth, said characterizing means comprising:

A. cooperating fixed and movable elongated clamping means, (1) said fixed clamping means (a) being fixed on said cover plate and (b) having an elongated upper surface area (i) which extends lengthwise substantially parallel to said side edges of the cover plate along a substantial portion of the length of the cover plate, and (ii) which is substantially parallel to and spaced above the upper surface of the cover plate;

(2) said movable clamping means being confined to movement downwardly to and upwardly away from an operative position in which said movable clamping means extends lengthwise substantially parallel to said fixed clamping means and in which an elongated bottom surface area on said movable clamping means that has a lengthwise extension substantially equal to that of said fixed clamping means is in substantially parallel and closely adjacent relationship to the upper surface of the cover plate and at a level below that of said surface area on the fixed clamping means; and (3) one of said clamping means comprising a pair of elements that are spaced small distances laterally to opposite sides of the other clamping means when the movable clamping means is in its operative position, so that overlappingly folded-over side portions of a garment confined between said clamping means extend undulatingly transversely across said surface areas to be foreshortened in the lateral direction for maintenance of lateral tension on the upper central portion of the garment; and B. actuating means connected with said movable clamping means for moving the same to and from its operative position.

2. The machine of claim 1 wherein said fixed clamping means comprises a pair of strip-like members mounted on the upper surface of said cover plate and extending in substantially parallel, laterally spaced relation to one another, and wherein said movable clamping means comprises an arm which, in its operative position, is disposed between said strip-like members in laterally spaced substantially parallel relation to both of them.

3. The machine of claim 2, further characterized by:

(1) means mounting said arm on said cover plate for up and down swinging motion relative to said cover plate about an axis transverse to said side edges of the cover plate; and (2) said actuating means being connected between said cover plate and said arm at a location on the arm which is spaced from said axis.

4. The machine of claim 3 wherein said actuating means comprises:

(1) a pneumatic cylinder actuator having a piston which moves in one direction in response to force exerted thereon by pressure air and thereby swings said arm downwardly to its operative position; and (2) spring means yieldingly biasing said piston in the opposite direction, for raising said arm with a light force.

5. The machine of claim 3, further characterized by: each of said side folding plates having a notch in its inner side edge through which said arm can pass in movement to its operative position at a time when the side folding plate is beginning its return movement towards it operative position.

* * * * *